United States Patent [19]

Selner

[11] 4,187,620

[45] Feb. 12, 1980

[54] BIOMECHANICAL SHOE

[76] Inventor: Allen J. Selner, 13320 Riverside Dr. #216, Sherman Oaks, Calif. 91423

[21] Appl. No.: 915,642

[22] Filed: Jun. 15, 1978

[51] Int. Cl.[2] ..... A43B 13/18; A43B 7/16

[52] U.S. Cl. ..... 36/28; 36/92

[58] Field of Search ..... 36/28, 29, 35 R, 35 B, 36/69, 71, 11.5, 92

[56] References Cited

U.S. PATENT DOCUMENTS

| | | | |
|---|---|---|---|
| 1,701,260 | 2/1929 | Fischer | 36/29 |
| 1,870,065 | 8/1932 | Nusser | 36/35 R |
| 2,007,803 | 7/1935 | Kelly | 36/29 |
| 2,721,400 | 10/1955 | Israel | 36/28 |
| 3,992,788 | 11/1976 | Orien et al. | 36/71 |

FOREIGN PATENT DOCUMENTS

| | | | |
|---|---|---|---|
| 944890 | 11/1948 | France | 36/28 |

*Primary Examiner*—Patrick D. Lawson

*Attorney, Agent, or Firm*—Nilsson, Robbins, Dalgarn, Berliner, Carson & Wurst

[57] ABSTRACT

A shoe is disclosed utilizing interrelated structural elements for dynamic cooperation with the human foot to reduce the likelihood of injury or deterioration during strenuous activity or over extended intervals of time, while affording greater comfort and ease of motion. The shoe bottom includes a sole above which a platform provides a plurality of cylindrical spaces that receive plugs in loose telescopic relationship, to define spaces for coil springs. So mounted, the coil springs are stabilized against lateral displacement.

Above the platform, the shoe bottom is affixed to an upper shoe covering to define a space for the wearer's foot. At the rear quarter of the shoe upper, a heel cup stabilizes the heel of a wearer's foot against lateral, medial, or posterior displacement as well as to distribute the forces on the heel reducing the likelihood of trauma. As disclosed, the heel cup comprises an air-containing bladder to provide a cushioned wedge which prevents excessive extension of the limb while allowing effective pronation.

Finally, a ridge is provided at the inner sole for gripping engagement by the toes (sulcus) for more effective use of the forward portion of the foot.

9 Claims, 6 Drawing Figures

BIOMECHANICAL SHOE

BACKGROUND AND SUMMARY OF THE INVENTION

Over the years, a multitude of shoe designs have been advanced with varying regard to style, comfort, and utility. Certainly, in some instances, utilitarian considerations have been almost totally disregarded in favor of style. As a related aspect, the structural features of a shoe are not always compatible in providing comfort while supporting the foot for movement. That is, a rather comfortable shoe may well impede the wearer in moving effectively or its use may be physically detrimental to the foot, leg, or back.

In recent years, considerable emphasis has been placed on the development of improved shoes for various athletic activities. In that regard, a number of specialized shoes have been developed and somewhat concurrently, a variety of structures have been proposed for incorporation in such shoes. For example, it has been proposed to provide coil springs in the platforms of shoes, as disclosed for example in U.S. Pat. Nos. 2,274,890 (Cunningham); 2,299,009 (Denk); 2,710,460 (Stasinos); 2,721,400 (Israel); and 4,030,213 (Daswick).

Another structural feature that previously has been proposed for shoes involves the incorporation of an air chamber in the platform of a shoe as to cushion the foot. Examples of such U.S. Pat. Nos. are: 4,008,530 (Gager); 4,012,854 (Berend et al); and 4,016,662 (Thompson).

Over the years, various other structures and forms have been proposed for use in shoes, both for special purposes and general use. However, in general a need continues to exist for a truly effective biomechanical shoe which can be economically produced for effective use.

In general, the present invention is directed to a biomechanical shoe which may be embodied in various embodiments, as for athletic use. The overall function of the shoe, as disclosed herein, is to enhance the normal foot and leg motion while running and to decrease abnormal motions. However, the shoe of the present invention may also be embodied in forms which conform to existing style requirements. Structurally, the shoe of the present invention incorporates a controlled-spring cushion platform which receives an upper incorporating a heel cup, which may take the form of a dynamic pneumatic cushion. At the forward insole of the shoe, a ridge or elevated area is provided to mate with the sulcus, affording improved action for the toes and related muscles of the foot.

BRIEF DESCRIPTION OF THE DRAWINGS

In the drawings, which constitute a part of this specification, an exemplary embodiment demonstrating the various objectives and features hereof are set forth as follows.

DESCRIPTION OF THE ILLUSTRATIVE EMBODIMENTS

As indicated above, detailed illustrative embodiments of the invention are disclosed herein. However, shoes may be embodied in accordance with various forms, some of which may be rather different from the disclosed illustrative embodiments. Consequently, the specific structural and functional details disclosed herein are merely representative, yet in that regard they are deemed to provide the best embodiments for purposes of disclosure and to provide a basis for the claims herein which define the scope of the present invention.

Figure 1:
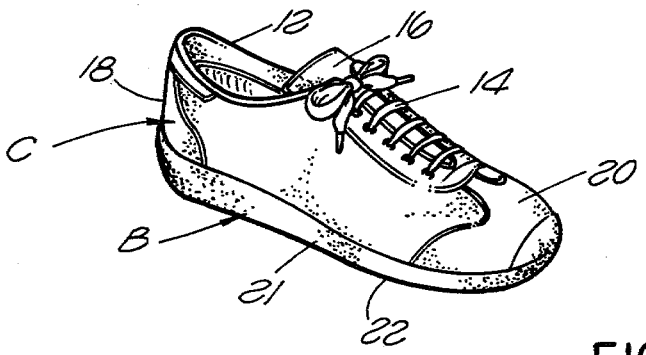
FIG. 1 is a perspective view of a biomechanical shoe constructed in accordance with the present invention.

Referring initially to FIG. 1, a shoe is illustrated for use in athletic activites and constructed in accordance with the present invention. As disclosed herein, the illustrative shoe consists of an upper shoe covering C and a shoe bottom B which includes a platform and sole as disclosed in detail below. The upper covering essentially defines a space for the human foot which is received through a collar 12 with the shoe being closed by a lacing 14 which extends forward from a throat 16. The upper covering C is illustrated to be reinforced and in that regard various overlays, seams, and thicknesses may be provided for reinforcement or decoration. In the illustrative form, as disclosed, a quarter overlay 18 is provided on the covering C along with an overlay 20 at the toe of the upper covering.

In general, the upper covering C is effectively bonded to the bottom B which is a composite of individual components. As illustrated in FIG. 1, the bottom B may be seen to include a platform 21 which is provided between the upper covering C and a sole 22. At this point in the description, it is perhaps significant to note that the shoe as depicted in FIG. 1 does not involve externally apparent structural departures from conventional athletic shoes. The point is noteworthy to illustrate that shoes of conventional appearance may be constructed in accordance with the present invention.

Considering the shoe of FIG. 1 in somewhat greater detail, reference will now be made to FIG. 2 wherein the upper covering C is represented in an integral form while the bottom B is shown in an exploded view to illustrate the individual components. Specifically, the bottom B includes a heel cup 24 which may be fitted into a lining (not separately shown) of the upper covering C. The details of the heel cup 24 are treated below; however, as disclosed herein, that structure is in a pneumatic form to provide effective cushioning along with well-distributed support.

The shoe bottom B also includes an innersole 26 which is of conventional shape, however, defines a crescent or arcuate ridge 28 for mating with the sulcus of the foot. The innersole 26 may be formed of a variety of materials which are somewhat resiliently deformable. Generally, synthetics afford a wide variety of alternatives for the basic innersole 26 which may then be covered with an absorbent layer (not shown). The ridge 28 can be molded in place or applied as a separately formed component.

The shoe bottom also includes a pair of mating platform members 30 and 32 which contain a multiplicity of coil springs 34. In general, the platform members 30 and 32 are mated together with the springs 34 therebetween to provide a form of stable cushioning. That is, the platform 21 as described in greater detail below, is very effective in absorbing the impact forces received by the foot during various activities; however, it is stable and in that regard provides lateral and longitudinal support for the foot. The platform 21, along with the other components illustrated in FIG. 2 are affixed together by a molding or peripheral tape 36 extending about the base of the shoe and in turn receiving the up-turned portions of the sole 22.

The individual components of the bottom B and the manner in which such elements are combined to provide the shoe as depicted in FIG. 1 will now be considered in somewhat greater detail.

The heel cup 24 (FIG. 2) includes a base 38 which is somewhat the shape of a half oval, and is integral with a somewhat arcuate perpendicularly rising pneumatic section 40. The base 38 provides a wedge under the wearer's heel for cushioned stabilization, and the tapered perpendicular section 40 provides support against horizontal displacement of the foot. The element is shown in detail in the sectional views of FIGS. 3 and 4 and in a plan in FIG. 5.

The perpendicular section 40 is hollow (FIG. 4) so that the heel cup 24 defines an air space 42 which cushions the heel while affording support. Furthermore, the space 42 is vented through a resilient form of check valve 44. Specifically, the valve 44 is simply formed of resiliently deformable or rubber-like material and structured to have different characteristics depending upon the direction of air flow. The valve 44 enables relatively free flow of air into the space 42; however, a significant quantity of air may be discharged from the space 42 through the valve 44 only when a significant positive pressure exists in the space 44. Various simple forms of such valves are well known in the prior art to accommodate the function of the heel cup 24.

Considering the structure of the heel cup 24 in somewhat greater detail, the unit may be formed of various tough, flexible yet impermeable materials as neoprene or other synthetics that are well known in the prior art. Techniques widely practiced in the forming of such materials may be utilized and may include molding and synthetic-material joining techniques. In general, the heel cup 24 should be formed to provide a particularly snug fit when the air space 42 is ventilated to capacity. Consequently, the material must have sufficient resiliency to refill the space by resuming a residual shape, after distortion, which expels air from the space 42.

Figure 4:
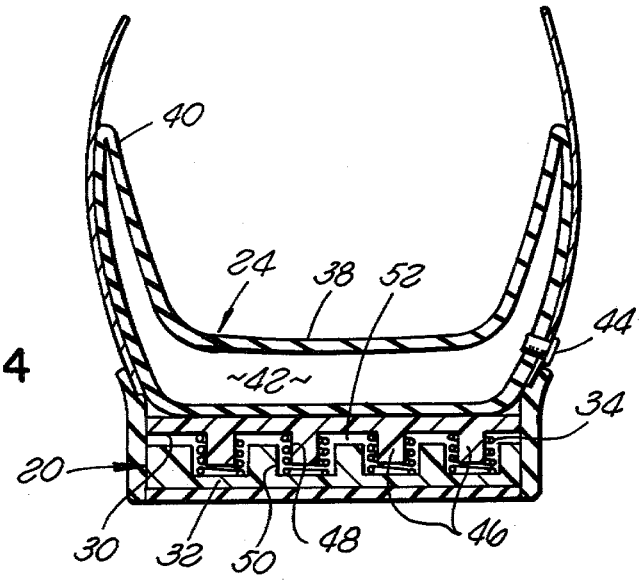
FIG. 4 is a horizontal sectional view taken substantially along the line 4—4 of FIG. 3.

The cushioning by the heel cup 24 is cooperative in effect with the cushioning of the platform 20 (FIG. 4) to considerably enhance the comfort and performance of the wearer while reducing fatigue and the likelihood of injury. As indicated above, the platform 20 includes the mated platform members 30 and 32 which define spaces for the springs 34. More specifically, as depicted in FIG. 4, the surfaces of the members 30 and 32 are offset both horizontally and vertically. The platform member 30 takes the form of a substantially flat sheet with an array of cylindrical pistons or plugs 46 extending from its base surface. To complement that configuration, the member 32 is a sheet defining cylindrical recesses 48 to loosely receive the plugs 46. As a consequence, cylindrical spaces 50 are provided about each of the plugs 46 to individually contain one of the springs 34. Also, upper and lower horizontal flat spaces 52 are provided between the members 30 and 32 as they are held in spaced-apart relationship by the springs 34. The spaces 52 are closed by the dynamic forces applied between a walking surface and the wearer's foot, consuming the energy of impact which may otherwise apply a force shock to the foot.

The members 30 and 32 may be made of similar resiliently deformable material as neoprene or other rubber-like substances; however, the material must be sufficiently rigid to afford the lateral support for resisting shear forces applied to the platform 20. Specifically, the plugs 46 should possess a force-compression ratio substantially greater than that ratio for the springs 34.

Figure 2:
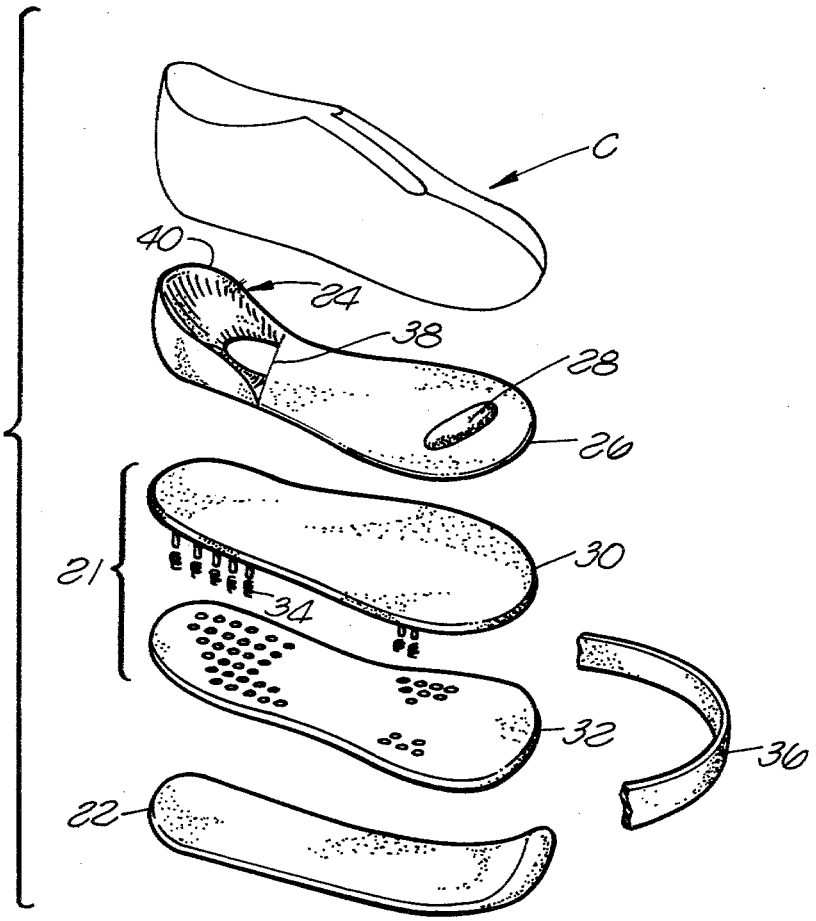
FIG. 2 is an exploded view of the shoe of FIG. 1.

In the construction of the shoe as disclosed herein, the platform 20 and the heel cup 24, along with the upper covering C and the other components represented in FIG. 2 will normally be fabricated separately as components preparatory to final assembly. In that regard, the platform 20 may be produced by molding sheets from which the mating members 30 and 32 can be cut. Thereafter, pairs of mating members 30 and 32 are married together with the springs 34 in position. A further step in the assembly then involves joining the platform 20 with the upper covering C (FIG. 2), the heel cup 24, and the innersole 26. These members are fixed together by the tape 36 which is secured about the periphery of the sandwiched members. Thereafter, the sole 22 is applied to the composite, completing the assembly of the shoe. Of course, in accordance with well known techniques, the assembly may well involve heated molds to accomplish the product as described.

Figure 3:
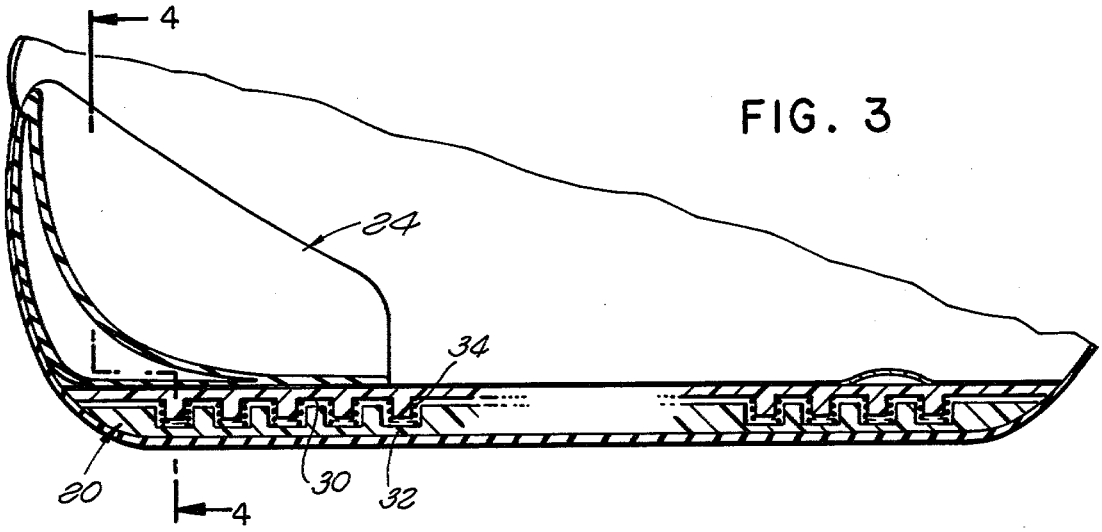
FIG. 3 is a vertical sectional view taken somewhat horizontally through the central length of the shoe of FIG. 1.

Considering the use of the shoe as disclosed herein, reference will now be made to FIG. 3. In general, it is desirable to cushion forces applied to the foot which are generally vertically oriented. However, as a similar generality, it is important to afford the foot horizontal support, i.e. laterally, posteriorly and anteriorly. That support is important to provide a firm support or reference from which motion can be developed. The foundation or support is reference to the foot by contact primarily with the bottom of the foot and through the heel. Consequently, in accordance with the present invention, it is important to provide uniform and firm support for the heel, specifically as afforded by the heel cup 24. Also, it is important to cushion the forces that are generally vertically applied to the heel as normally, the initial impact of planting the foot is primarily by the heel. In the operation of the shoe as disclosed herein, the forces resulting from such impact are largely absorbed by the platform 20 and the heel cup 24. The energy of such forces is dissipated by internal friction as well as the coil springs 34 and actuation of the valve 44.

Although the most severe forces are normally taken by the heel, as the forward portion of the foot impacts, the forces move forward. Such forces are absorbed by the springs 34 in the platform 20. In that manner, the impact forces of placing the foot are largely dissipated within the shoe rather than to stress the foot or leg of the wearer.

After the foot is well grounded, the heel is usually raised with the toes performing a gripping action to facilitate forward motion. Such gripping action by the toes is effectively enhanced by the ridge 28 (FIG. 3) which to some extent mates with the open space (sulcus) under the toes. Thus, a rolling motion for the foot is facilitated with the forces of impact substantially reduced and the gripping action of the toes enhanced.

Figure 5:
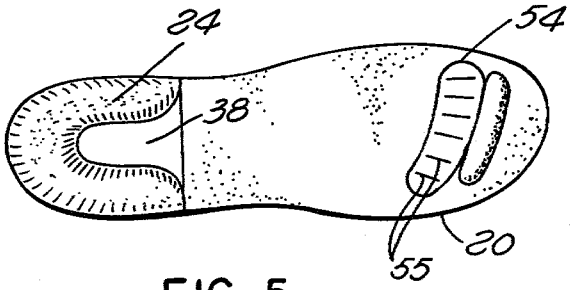
FIG. 5 is a plan view illustrating an alternative form of the shoe of the present invention.

The initial action involved with lifting the foot also involves some torquing action generally in the area of the ball of the foot. In various embodiments of the shoe hereof, that torquing action may be accommodated to various degrees. That is, as the wearer's foot torques to accomplish the desired motion pattern, resiliency in the shoe is provided to accommodate the twisting motion. In one such form of shoe, the springs 34 are simply omitted from the platform 20 at the torquing area. Specifically, as depicted in FIG. 5, an area 54 of the platform 20 indicates the portion of the platform from which the springs 34 would be omitted. As a consequence, torsional forces applied to the platform 20 across the opposed surfaces indicated by the area 54 are flexibly accommodated to a limited extent. In other forms of shoes constructed in accordance with the present invention, the platform 20 may be formed to include ridges 55 or other supports in the area 54 which will readily yield to accommodate some torsional displacement.

Figure 6:
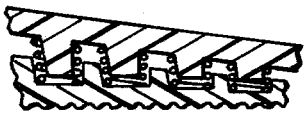
FIG. 6 is a fragmentary view of the structure of FIG. 4 illustrating an alternative embodimentl

As indicated above, the shoe of the present invention may be worn to effectively support the foot of the wearer while concurrently cushioning forces by dissipating the energy of impact. In that regard, it is important to appreciate the characteristic of the shoe to actually dissipate energy which might otherwise simply be distributed in its application to the foot. Of course, as indicated above, the shoe affords ridid support for the wearer with the consequence that protection is provided without the compromise of impairing desired motion patterns. Of course, the shoe may be constructed with various modifications depending upon specific purpose, style, and individual needs. For example, shoes may be constructed with the platforms laterally tapered as illustrated in FIG. 6. Such variations in the platform may be used to effectively compensate for physical variations of the feet of individual wearers. Such compensations may be corrective in nature or serve to improve individual physical performance. Accordingly, several variations of the basic embodiments are apparent and the scope hereof shall not be referenced to the disclosed embodiments but on the contrary shall be determined in accordance with the claims as set forth below.

What is claimed is:

1. An athletic shoe comprising:

an upper covering;

a shoe bottom including a platform including a pair of platform members, one of said platform members defining a plurality of substantially vertical cylinder spaces disposed about said platform member, and said other platform member defining a plurality of plugs matingly aligned with said cylinder spaces, and said platform further including a plurality of coil springs disposed about said plugs to hold said platform members spaced apart in the absence of load; and means for affixing said shoe bottom to said upper covering with said platform members aligned.

2. A shoe according to claim 1 wherein said plugs are of a material having a force-compression ratio substantially greater than the force compression ratio of said coil springs.

3. A shoe according to claim 1 wherein said upper covering further includes a heel cup for providing firm support about said heel.

4. A shoe according to claim 1 wherein said shoe bottom further includes inner sole means defining a ridge for extension into the sulcus of the foot.

5. A shoe according to claim 4 wherein said ridge comprises resiliently deformable material.

6. A shoe according to claim 1 wherein said plugs are of a material having a force-compression ratio substantially greater than the force compression ratio of said coil springs, wherein said upper covering further includes a heel cup for providing firm support about said heel, and wherein said shoe bottom further includes inner sole means defining a ridge for extension into the sulcus of the foot.

7. An athletic shoe comprising:

an upper covering;

a shoe bottom incorporating a platform and a sole, affixed to said upper covering to define a space to receive a person's foot; and a heel cup fitted into a heel portion of said space for providing firm support about the heel of said person's foot, said heel cup comprising a bladder of resiliently deformable material defining an airspace for supporting the calcaneus of the foot.

8. A shoe according to claim 7 further including valve means for allowing the passage of air into and out of said bladder with the expenditure of energy.

9. A shoe according to claim 7 wherein said shoe bottom further includes inner sole means defining a ridge for extension into the sulcus of the foot.

* * * * *